US007637065B2

(12) United States Patent
Ahren et al.

(10) Patent No.: US 7,637,065 B2
(45) Date of Patent: Dec. 29, 2009

(54) PANEL ATTACHMENT CLIP

(75) Inventors: Gregory M. Ahren, Lakewood, OH (US); John D. Bankston, Amherst, OH (US); James A. Fletterick, Olmsted Falls, OH (US)

(73) Assignee: USG Interiors, Inc., Chicago, IL (US)

( * ) Notice: Subject to any disclaimer, the term of this patent is extended or adjusted under 35 U.S.C. 154(b) by 436 days.

(21) Appl. No.: 11/256,894

(22) Filed: Oct. 24, 2005

(65) Prior Publication Data

US 2007/0101670 A1 May 10, 2007

(51) Int. Cl.
*E04B 2/00* (2006.01)

(52) U.S. Cl. ..... 52/506.06; 52/713

(58) Field of Classification Search ..... 52/127.12, 52/127.7, 506.06, 665, 713; 248/200, 228.1, 248/228.7, 300

See application file for complete search history.

(56) References Cited

U.S. PATENT DOCUMENTS

| | | | | | |
|---|---|---|---|---|---|
| 2,307,653 | A | | 1/1943 | Wright | |
| 2,586,327 | A | | 2/1952 | Haertel | |
| 2,631,809 | A | * | 3/1953 | Jacobson | 248/317 |
| 3,233,297 | A | * | 2/1966 | Havener | 403/397 |
| 3,558,091 | A | * | 1/1971 | Bush | 248/317 |
| 3,608,857 | A | * | 9/1971 | Hibbeler | 248/317 |
| 4,047,353 | A | * | 9/1977 | Aarons | 52/713 |
| 4,723,749 | A | * | 2/1988 | Carraro et al. | 248/317 |
| 4,905,952 | A | * | 3/1990 | Pinquist | 248/317 |
| 5,029,425 | A | | 7/1991 | Bogataj | |
| 5,335,890 | A | | 8/1994 | Pryor et al. | |
| 6,260,810 | B1 | | 7/2001 | Choi | |
| 6,763,641 | B1 | | 7/2004 | Ahren et al. | |
| 6,904,730 | B2 | * | 6/2005 | Mitchell | 52/536 |
| 7,219,863 | B1 | * | 5/2007 | Collett, II | 248/68.1 |
| 2004/0172907 | A1 | | 9/2004 | Krantz-Lilenthal et al. | |

OTHER PUBLICATIONS

Armstrong Architectural Specialties "MetalWorks Curved Panel System", 1 page (undated) labeled "A".
Armstrong Architectural Specialties "MetalWorks RH 200 Hook-On", 1 page (undated) labeled "B".
International Search Report and Written Opinion dated Sep. 28, 2007 in PCT/US06/32202.

* cited by examiner

*Primary Examiner*—Richard E Chilcot, Jr.
*Assistant Examiner*—Jessica Laux
(74) *Attorney, Agent, or Firm*—Pearne & Gordon LLP

(57) ABSTRACT

A clip for suspending ceiling panels from a horizontal channel having a C-shape formed by a vertical web and integral opposed horizontal upper and lower flanges, the clip comprising a sheet metal body, the body including a vertical web extending between upper and lower portions, the upper portion being configured to overlie the horizontal upper flange of the channel when installed thereon, the lower portion being configured to lie below the horizontal lower flange of the channel, the lower portion including a generally upstanding hook section adapted to be received in a downwardly open channel on the ceiling panel beneath the C-shaped channel to enable the clip to support the panel by transferring the weight of the panel to the C-shaped channel, the hook section being fixed against horizontal movement relative to the body vertical web.

9 Claims, 4 Drawing Sheets

PANEL ATTACHMENT CLIP

BACKGROUND OF THE INVENTION

The invention relates to suspended ceilings and, in particular, to improvements in gridless type suspended ceilings.

PRIOR ART

U.S. Pat. No. 6,763,641 discloses a suspended ceiling construction that uses non-rectangular planks or metal pans butted together at their edges and supported directly by overhead suspension wires. Some overhead structures or superstructures make it difficult to hang suspension wires, particularly when such wires are required on specific overhead centers. When the suspended ceiling is a so-called free-form type and does not have a rectangular or an otherwise regular pattern, the layout of the anchor points for the suspension wires is difficult and can be extremely time consuming. Typically, a convenient anchor point will not lie directly above a location where a ceiling panel is designed to receive a wire. This condition can tax the skill and patience of the installer in an effort to find the best compromise to avoid shifting and/or distortion of the ceiling panels because of the side forces developed by angled suspension wires.

SUMMARY OF THE INVENTION

The invention provides a system for quickly and accurately suspending free-form ceiling panels. The system relies on a novel clip for connecting the panels to a set of overlying channels. The channels are situated in a plane just above the plane in which the ceiling panels are to be hung. With the channels suitably in place, the clips are assembled on the channels. The illustrated clips are readily installed and locked onto the channels without the need for separate fasteners or tools. Once the clips are assembled on the channels, the ceiling panels can be hung on the clips and thereby be suspended by the channels. The clips preferably have bendable tabs that, when deployed, lock the panels against accidental or unauthorized vertical movement and consequent separation from the clips.

In one embodiment of the clip, a panel engaging hook is pivotally connected to upper portions of the clip. The pivot connection allows the hook to be twisted about a vertical axis to an angle that matches the angle between the edge of the panel to be supported and the respective channel.

DESCRIPTION OF THE PREFERRED EMBODIMENTS

Figure 1:
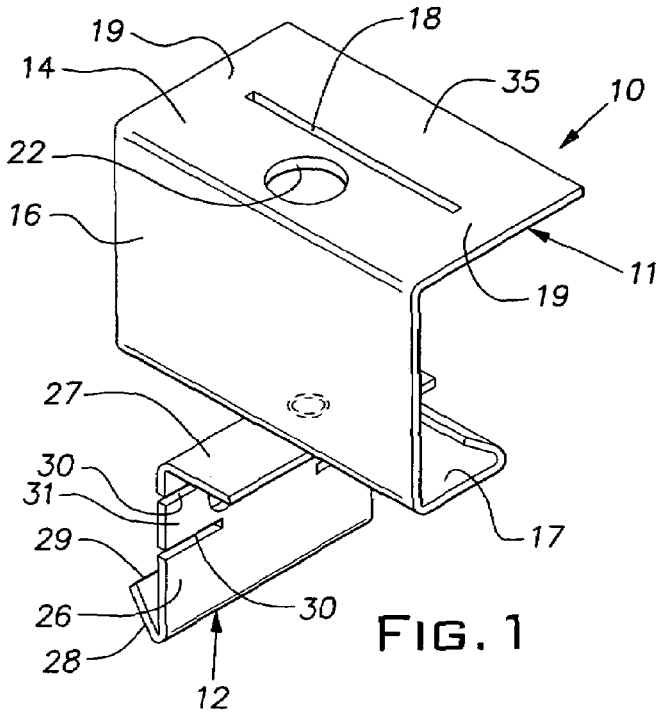
FIG. 1 is a perspective view of a first embodiment of the panel attachment clip of the invention.
Figure 2:
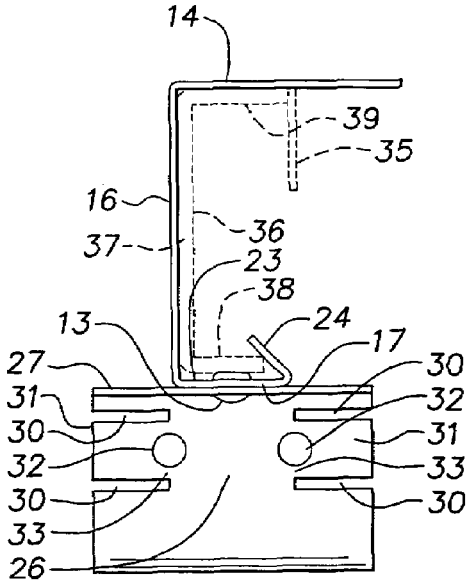
FIG. 2 is a front elevational view of the clip of FIG. 1.
Figure 3:
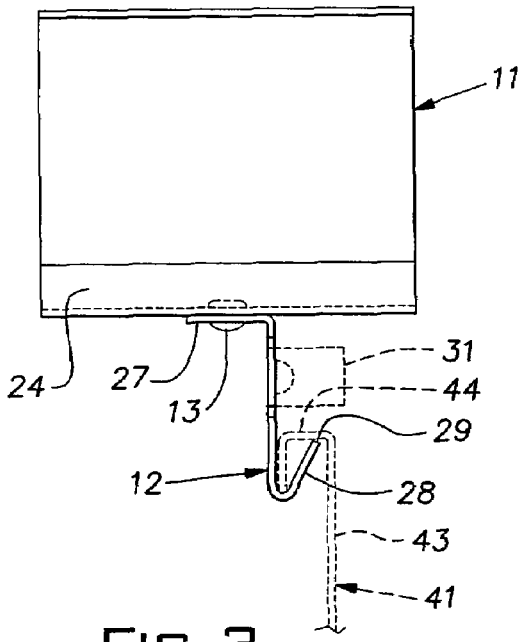
FIG. 3 is a side elevational view of the clip of FIG. 1.

Referring now to the drawings and, in particular, to FIGS. 1-3, there is shown a first embodiment of the panel attachment clip 10 of the invention. The clip or bracket 10 is a body formed of two pieces of steel sheet or other suitable metal.

The clip includes an upper part 11 and a lower part 12 permanently joined together by a rivet 13. The upper part 11, initially, has a flat horizontal section 14, a vertical web 16 and a bottom section 17. The top section 14 has an elongated slot 18 leaving small land areas 19 at each end so as to establish a bend line through the slot and the land areas 19 parallel to the web 16. A hole 22 in the top section 14 provides access for a tool to install the rivet 13. The bottom section 17 has a horizontal zone 23 with an integral reversely bent or re-entrant lip 24 that, as described later, catches on the flange of a supporting channel shown in phantom at 36 in FIG. 2.

The lower part 12 of the clip body has a vertical web 26 and an integral horizontal flange 27. Bent upwardly from a lower edge of the web 26 is a generally upstanding flange or hook 28 having a free edge 29. The vertical web 26 of the lower body part 12 has slots 30 at its vertical edges to form tabs 31 at these edges. Holes 32 associated with an inner end of the tabs 31 reduce the strength of the web along bend lines 33 created between the holes and tab forming slots 30.

The clip 10 can be mounted on a conventional cold rolled steel channel 36. Such channels are used in the trade and are typically 1½" in nominal web width. The width of the channel flanges may be ⅜", 7⁄16", or 5⁄16" or a similar dimension. In use, the channel web 37 is ordinarily positioned in a vertical plane. The clip 10 is installed on the channel 36 by tilting it to enable the lip 24 to enter the interior of the channel 36 and catch on the lower flange, designated 38 of the channel and then by swinging the body of the clip so that it is upright and the web 16 of the top section 14 abuts or is closely adjacent and parallel to the channel web 37. With the clip in this upright position, the distal part 35 of the horizontal top section 14 beyond the bend line 21 is bent down around the upper flange, designated 39 of the channel 36 to lock the clip 10 on the channel. FIG. 2 illustrates the channel 36 and the bent portion 35 of the top section 14 in phantom.

Figure 4:
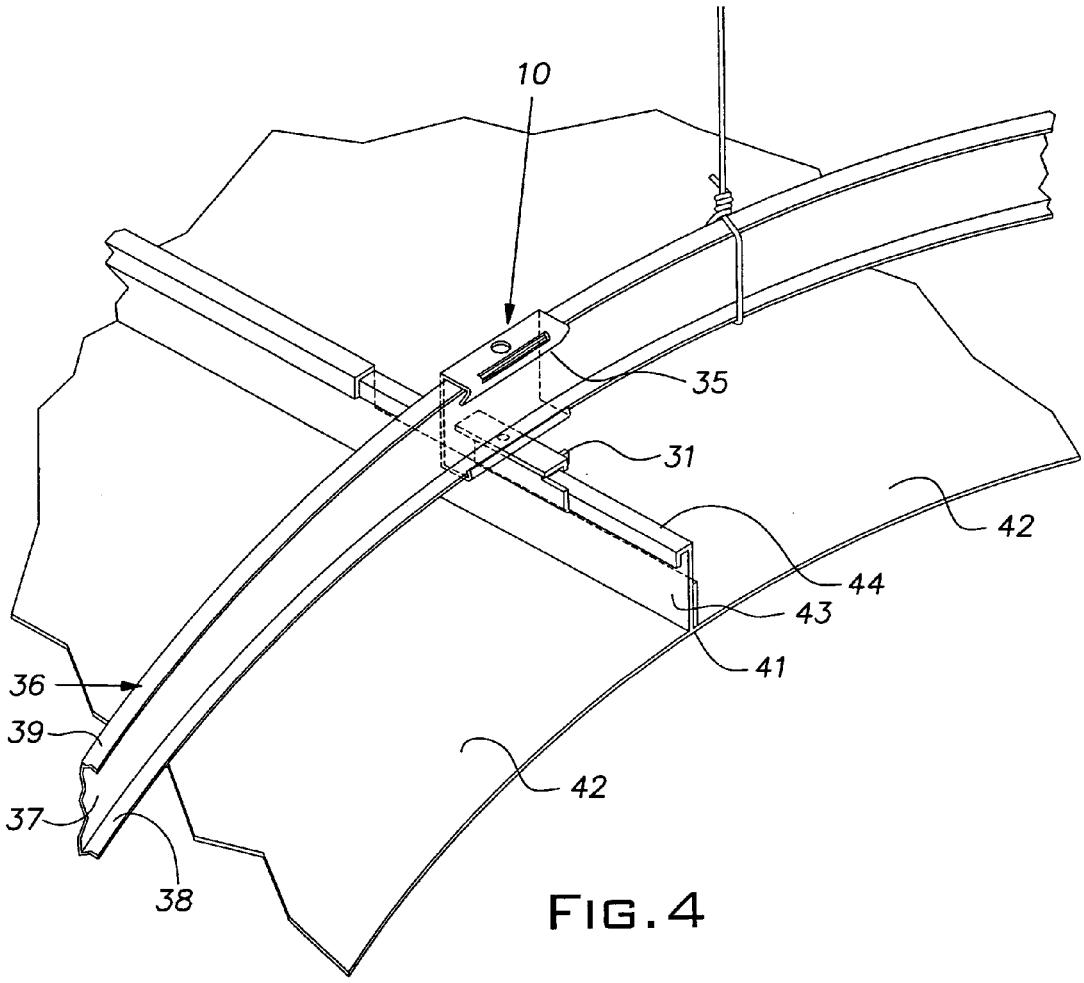
FIG. 4 is a perspective view of a part of a suspended ceiling system employing the clip of FIGS. 1-3.

With reference to FIG. 4, the clip 10 is located longitudinally on the channel 36 over an edge 41 of a panel 42 to be suspended. Reference is made to aforementioned U.S. Pat. No. 6,763,641 for details on the construction of the ceiling panels.

An edge portion 41 of the panel 42 is illustrated in phantom in FIG. 3. The edge 41 of the panel includes an upstanding flange 43 which forms an inverted channel 44. The inverted channel 44 receives the hook 28 of a respective clip 10. Once the channel 44 is received on a hook 28, as shown in phantom in FIG. 3, one or both of the tabs 31 can be bent out of their original plane, as also indicated in phantom, so that they overlie the channel 44 and hook 28. The panel 42 is thereby locked on the clip 10 because the tab or tabs 31 prevent the panel from being lifted due to interference with the adjacent area of the channel 44.

Figure 5:
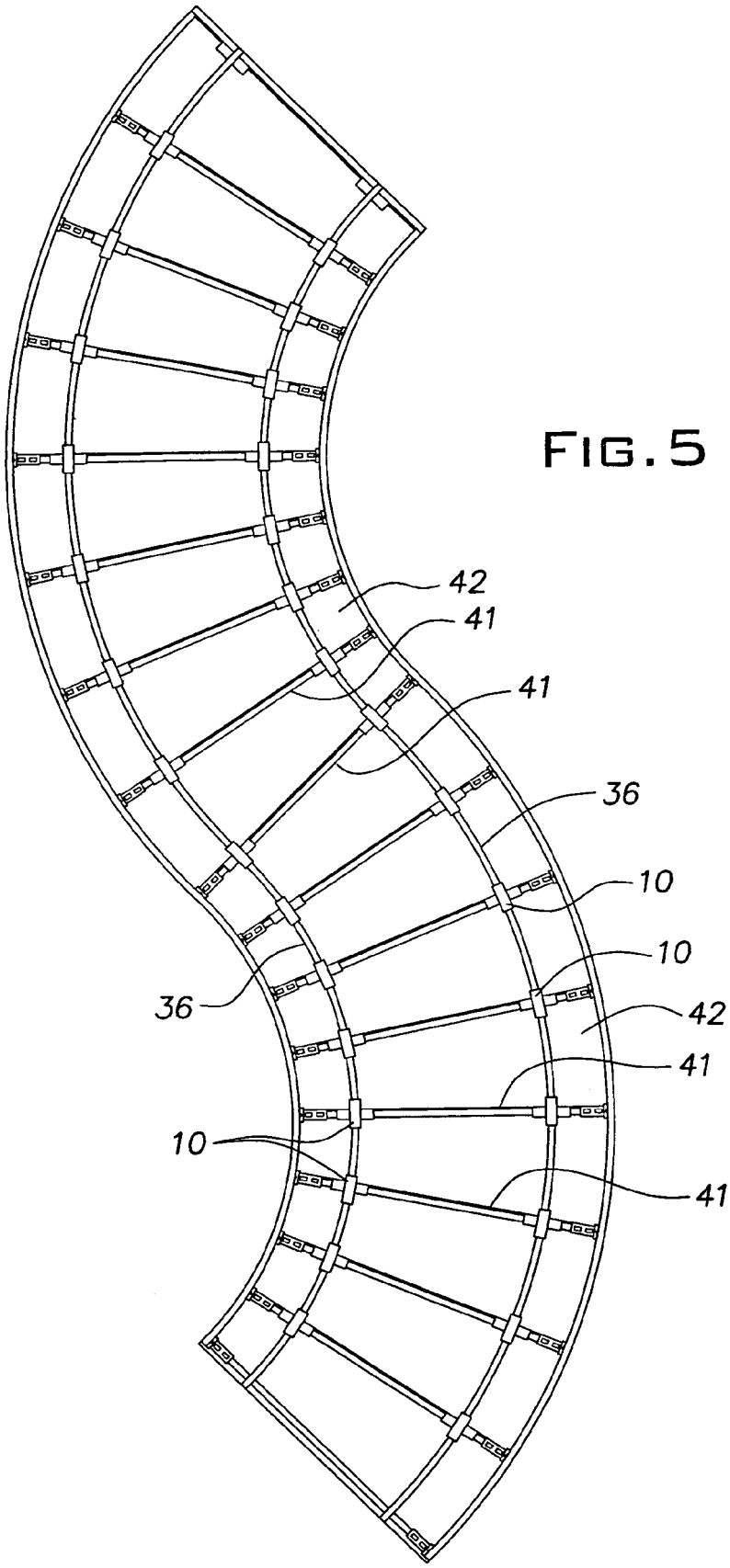
FIG. 5 is a plan view of a free form suspended ceiling system as viewed from above in which the clips of the invention are utilized.

FIG. 5 illustrates an example of an installation of a free form suspended ceiling that is of the island-type, as viewed from above. Preferably, the channels 36 are rolled or otherwise bent out of their original straight manufactured condition so that they generally follow the form of the eventual suspended ceiling and, to the extent practical, are locally perpendicular to the straight edges of the panels 42. Desirably, the channels 36 are located inboard of the free form ends of the panels 42 so that they are not seen from the occupied space below the ceiling and the suspension wires are similarly hidden or difficult to see, thereby obtaining a cleaner, more dramatic appearance. The channels 36 need not be precisely located nor do wires suspending the channels need be at specific points along the length of the channels. This very loose tolerance in the placement of the channels 36 is permitted because even precise location of the panels 42 can be accomplished by simply sliding the clips 10 along the channels 36 to obtain a lengthwise position and by sliding the channels of the panels 42 transversely to the support channels 36. Consequently, it is easy to accurately position the panels 42 to their specified positions. The pivotal connection between the upper and lower parts 11, 12 of the clip provided by the rivet 13 enables the installer to adjust the hook 28 so that it is parallel to the straight edge of the panel 42 being installed regardless of the local orientation of the supporting channel 36. While the rivet 13 is shown as a separate piece it can, alternately, be formed integrally out of one or both of the parts 11, 12.

Figure 6:
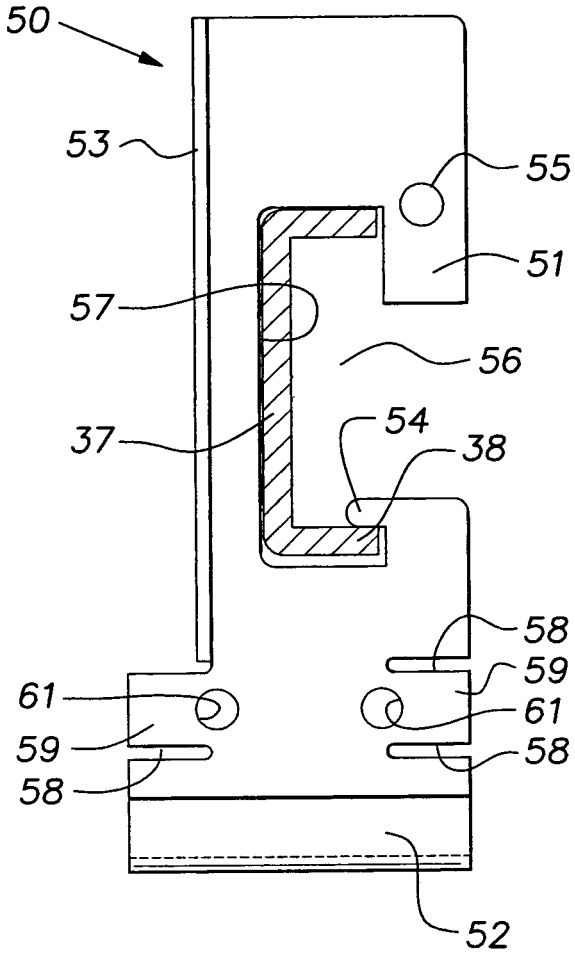
FIG. 6 is a front elevational view of a clip constructed in accordance with a second embodiment of the invention.
Figure 7:
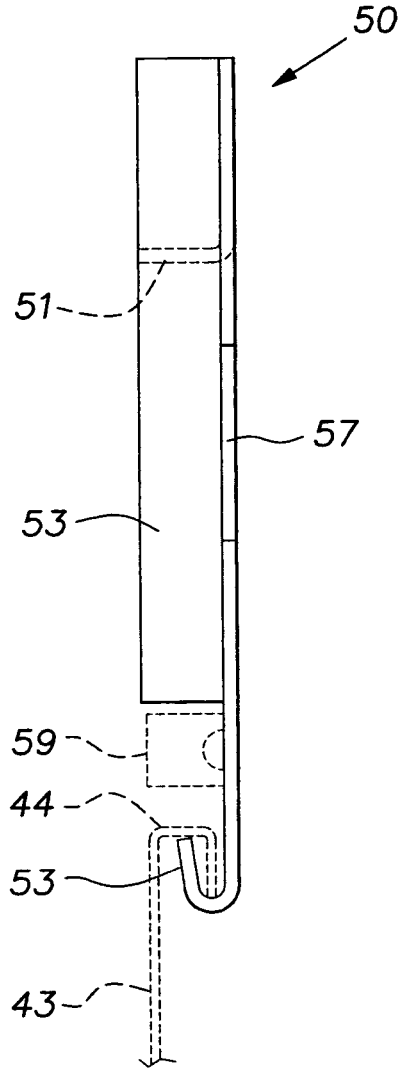
FIG. 7 is a side elevational view of the clip of FIG. 6.

FIGS. 6 and 7 illustrate another embodiment of the invention in which a clip or bracket 50 is a one piece body. The clip is preferably formed of a single sheet of cold roll steel or other suitable metal. The body of the clip 50 is generally planar apart from a hook 52 and a stiffening flange 53. The clip 50 is formed with a lip or catch 54 which projects into a rectangular cutout 56 adapted to receive a channel 36. The lip 54 with adjacent areas of the body of the clip 50 surround the inner, outer and edge surfaces of the channel flange 38 when the clip is properly installed. A locking tab 51 can be manufactured so that it is bent out of the main plane of the clip body 50 or can be manufactured in the plane and temporarily manually bent out of this condition into the phantom configuration of FIG. 7. The clip 50 is installed by tilting it so that an edge 57 of the cutout 56 is out of plumb. In this orientation, the lip 54 is caused to catch on the lower channel flange 38 and the clip is then rotated to an upright condition where the edge 57 is vertical and close to or abuts the channel web 37. The locking tab 51 is then bent downwardly into the vertical plane of the clip body proper to lock the clip 50 onto the channel 36. A hole 55 creates a bend line at the base of the tab 51 to facilitate manual bending.

A lower part of the body of the clip 50 is slotted at 58 from opposite edges to form oppositely extending locking tabs 59. Holes 61 are formed at the inner ends of the locking tabs to create bend lines in the remaining areas of the clip body between the holes 61 and end of the slots 58. A panel 42 is installed by positioning the inverted channel 44 of the panel on the hook 52. The panel 42 can be locked against unwanted removal from its installed position by bending the tabs 59 out of their original plane and over the adjacent areas of the inverted channel 44 in essentially the same manner as described in connection with the clip of FIG. 10.

The clip 50 is used in essentially the same way as that described in connection with the clip 10 in situations where there is limited deviation from a perpendicular relation between a panel edge 43 carrying the inverted channel 44 and the supporting channels 36. The horizontal width of the rectangular cutout 56 can be made somewhat oversize in relation to the width of the channel flanges 38, 39 so as to allow the clip 50 to be turned out of square with the channel and accommodate a deviation of the panel edges 43 from an exactly transverse condition.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A clip for suspending ceiling panels from a horizontal channel having a C-shape formed by a vertical web and integral opposed horizontal upper and lower flanges, the clip comprising a sheet metal body, the body including a vertical web extending between upper and lower portions, the upper portion being configured to overlie the horizontal upper flange of the channel when installed thereon, the lower portion being configured to lie below the horizontal lower flange of the channel, the lower portion including a generally upstanding hook section with a free edge adapted to be received in a downwardly open channel on the ceiling panel beneath the C-shaped channel to enable the clip to support the panel by transferring the weight of the panel to the C-shaped channel, the hook section being fixed against horizontal movement relative to the body vertical web;

wherein said hook is pivotally connected to an overlying part of the clip body for rotational movement relative to said overlying part about a vertical axis.

2. A clip as set forth in claim 1, wherein the upper portion includes a bend zone relatively weaker than surrounding areas of the upper portion enabling a part of the upper portion to be bent from a high position to a low position to wrap a portion of a side of the C-shaped channel opposite a side of the channel adjacent said body vertical web.

3. A clip as set forth in claim 2, wherein said lower portion includes a catch section configured with adjacent clip areas to surround three sides of the C-shaped channel lower flange.

4. A clip as set forth in claim 1, wherein said body includes a bendable tab capable of being bent over a panel channel engaged by said hook in a manner that vertically locks said panel relative to said clip.

5. A method of erecting a suspended ceiling comprising establishing an array of support channels in a horizontal plane spaced above the plane of the finished part of the ceiling visible from below, hanging a plurality of clips on the support channels in spaced relation to one another, the clips being spaced from one another along the length of each of the channels, the clips each having an upper section overlying the respective channel such that the clip is vertically supported on the upper side of the channel and being provided at a lower section with an upwardly extending hook, hanging panels on the clips by setting inverted channels on the edge of the panels over the hooks; wherein said hook is pivotally connected to an overlying part of the clip body for rotational movement relative to said overlying part about a vertical axis.

6. A method as set forth in claim 5, wherein the inverted channels of the panels are locked on respective clips by bending a tab of a clip over the inverted channel after the channel has been positioned over a hook.

7. A method as set forth in claim 5, wherein the clip is locked on the support channel by engaging a catch formed on a part of the clip adapted to extend below the support channel and into the interior of the support channel, and thereafter bending a zone of an upper part of the clip down below the upper side of the support channel.

8. A suspended ceiling system comprising a plurality of metal support channels located in a common horizontal plane, the channels having webs lying in vertical planes and upper and lower flanges lying in horizontal planes, a plurality of clips spaced along the length of each of the channels, each clip extending along the channel upper flange, web and lower flange, respectively, each clip including a hook supported on a part of the clip extending along the channel lower flange, the hook extending generally upwardly to a free edge, a plurality of ceiling panels having upwardly extending flanges at their edges, the flanges including inverted channels hung on the hooks of said clips; wherein said hook is pivotally fixed to a clip part in a manner that permits it to rotate relative to said clip part about a vertical axis to align said hook to a straight edge of an underlying panel.

9. A suspended ceiling as set forth in claim 8, wherein said clips include bendable tabs bent over said panels after said panels are hung on said hooks to prevent inadvertent or unauthorized lifting of said panels.

* * * * *

UNITED STATES PATENT AND TRADEMARK OFFICE

CERTIFICATE OF CORRECTION

PATENT NO. : 7,637,065 B2
APPLICATION NO. : 11/256894
DATED : December 29, 2009
INVENTOR(S) : Ahren et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 817 days.

Signed and Sealed this

Ninth Day of November, 2010

David J. Kappos

David J. Kappos
*Director of the United States Patent and Trademark Office*